US012669273B2

(12) United States Patent
Taras et al.

(10) Patent No.: US 12,669,273 B2
(45) Date of Patent: Jun. 30, 2026

(54) SYSTEMS AND METHODS FOR DEFROST OF HEAT PUMP SYSTEMS

(71) Applicant: Goodman Manufacturing Company, L.P., Waller, TX (US)

(72) Inventors: Michael F. Taras, The Woodlands, TX (US); David L. Boyea, Houston, TX (US)

(73) Assignee: Goodman Manufacturing Company, L.P., Waller, TX (US)

( * ) Notice: Subject to any disclaimer, the term of this patent is extended or adjusted under 35 U.S.C. 154(b) by 0 days.

(21) Appl. No.: 18/582,998

(22) Filed: Feb. 21, 2024

(65) Prior Publication Data

US 2024/0191918 A1 Jun. 13, 2024

Related U.S. Application Data

(62) Division of application No. 17/655,016, filed on Mar. 16, 2022, now Pat. No. 11,940,189.

(51) Int. Cl.

| | |
|---|---|
| ***F25B 30/02*** | (2006.01) |
| ***F24F 11/41*** | (2018.01) |
| ***F24F 13/10*** | (2006.01) |
| ***F25B 47/02*** | (2006.01) |

(52) U.S. Cl.

CPC ..... *F25B 30/02* (2013.01); *F24F 11/41* (2018.01); *F24F 13/10* (2013.01); *F25B 47/022* (2013.01); *F25B 2339/047* (2013.01); *F25B 2400/0403* (2013.01); *F25B 2500/18* (2013.01); *F25B 2500/19* (2013.01); *F25B 2700/133* (2013.01); *F25B 2700/2106* (2013.01); *F25B 2700/21151* (2013.01)

(58) Field of Classification Search

CPC . F24F 11/41; F24F 11/42; F25B 30/02; F25B 47/022; F25B 2400/0403; F25B 2700/2106

See application file for complete search history.

(56) References Cited

U.S. PATENT DOCUMENTS

| | | | | |
|---|---|---|---|---|
| 5,752,389 A * | 5/1998 | Harper | F24F 11/88 | 62/176.5 |
| 6,263,686 B1 * | 7/2001 | Burkhart | F25D 21/008 | 62/155 |
| 2008/0196426 A1 * | 8/2008 | Taras | F24F 3/153 | 62/173 |
| 2012/0239208 A1 * | 9/2012 | Federspiel | F24F 11/62 | 700/277 |
| 2013/0019615 A1 * | 1/2013 | Choi | B60H 1/00914 | 62/238.7 |
| 2019/0178509 A1 * | 6/2019 | Taras | F25B 30/02 | |

* cited by examiner

*Primary Examiner* — Jonathan Bradford

(57) ABSTRACT

The present disclosure relates to a heating, ventilation, and air conditioning ("HVAC") system include a supply damper, a return damper, and a defrost damper which are operable to control a supply airflow, a return airflow, and a defrost airflow to flow between a supply duct, a return duct, and an indoor heat exchanger without substantially flowing into and substantially cooling an indoor space. A reheat coil may also warm the supply air flow and a defrost return line may be used to bypass a bi-flow expansion device and an indoor heat exchanger.

4 Claims, 6 Drawing Sheets

SYSTEMS AND METHODS FOR DEFROST OF HEAT PUMP SYSTEMS

CROSS-REFERENCE TO RELATED APPLICATION

This application is a divisional application claiming priority under 35 U.S.C. § 121 to U.S. patent application Ser. No. 17/655,016 entitled "SYSTEMS AND METHODS FOR DEFROST OF HEAT PUMP SYSTEMS", filed Mar. 16, 2022, the entire disclosure of which is hereby incorporated by reference.

BACKGROUND

This section is intended to provide relevant background information to facilitate a better understanding of the various aspects of the described embodiments. Accordingly, these statements are to be read in this light and not as admissions of prior art.

A heat pump is a refrigerant system that is operable in both cooling and heating modes. While air conditioners are familiar examples of heat pumps, the term "heat pump" is more general and applies to many heating, ventilating, and air conditioning ("HVAC") devices used for space heating or space cooling. When a heat pump is used for heating, it employs the same basic refrigeration-type cycle used by an air conditioner or a refrigerator, but in the opposite direction, releasing heat into the conditioned space rather than the surrounding environment. In this use, heat pumps generally draw heat from cooler external air, water, or from the ground.

In a cooling mode, a heat pump operates like a typical air conditioner, i.e., a refrigerant is compressed in a compressor and delivered to a condenser (or an outdoor heat exchanger). In the condenser, heat is exchanged between a medium such as outside air, water, or the like and the refrigerant. From the condenser, the refrigerant passes to an expansion device, at which the refrigerant is expanded to a lower pressure and temperature, and then to an evaporator (or an indoor heat exchanger). In the evaporator, heat is exchanged between the refrigerant and the indoor air, to condition the indoor air. When the refrigerant system is operating, the evaporator cools the air that is being supplied to the indoor environment. In addition, as the temperature of the indoor air is lowered, moisture usually is also taken out of the air. In this manner, the humidity level of the indoor air can also be controlled.

Reversible heat pumps (generally referred to herein simply as "heat pumps") work in either direction to provide heating or cooling to the internal space as mentioned above. Reversible heat pumps employ a reversing valve to reverse the flow of refrigerant from the compressor through the condenser and evaporation coils. In heating mode, the outdoor coil is an evaporator, while the indoor coil is a condenser. The refrigerant flowing from the evaporator (outdoor coil) carries the thermal energy from outside air (or source such as water, soil, etc.) indoors. Vapor temperature is augmented within the pump by compressing it. The indoor coil then transfers thermal energy (including energy from the compression) with the indoor air, which is then moved around the inside of the building by an air handler. The refrigerant is then allowed to expand, cool, and absorb heat from the outdoor temperature in the outside evaporator, and the cycle repeats. This is a standard refrigeration cycle, save that the "cold" side of the refrigerator (the evaporator coil) is positioned so it is outdoors where the environment is colder.

When operating in heating mode, heating is being provided to the internal spaces within a building, and thus the outdoor ambient temperatures are relatively cold when the outside evaporator is on the "cold" side of the refrigeration cycle. This combination of cold outdoor ambient temperatures and cold refrigerant within the outside evaporator can result in ice formation on the outside evaporator. This ice formation may be removed by "defrosting" the outside evaporator, to protect the compressor and to maintain the efficiency of heat transfer between the refrigeration system and the outdoor environment. One solution for defrosting the outdoor heat exchanger is to reverse the flow of the refrigerant in the refrigeration cycle so that the outdoor heat exchanger acts as the condenser and the indoor heat exchanger acts as the evaporator. By reversing the refrigerant flow in this manner, the outdoor heat exchanger is placed on the "hot" side of the refrigeration cycle and any ice formation of the outdoor heat exchanger is melted. However, this method of defrosting places the refrigeration system into a cooling mode for the internal spaces within a building, which is not desirable when experiencing colder outdoor ambient temperatures. Therefore, an electric heater is typically used to reheat the indoor air flowing into the conditioned space. However, the electric heaters are costly, inefficient and require significant development efforts.

SUMMARY

Some embodiments disclosed herein are directed to a HVAC system operable to use a refrigerant to heat or cool an indoor space, the HVAC system includes a compressor, an outdoor heat exchanger, an indoor heat exchanger, a bi-flow expansion device, and a four-way valve operable to flow the refrigerant through the bi-flow expansion device in a first direction in a cooling mode and in a second direction, opposite the first direction, in a heating mode. Additionally, some embodiments include a supply duct including a supply damper operable to control a supply airflow through the supply duct from the indoor heat exchanger to the indoor space. In addition, a return duct including a return damper operable to control a return airflow through the return duct from the indoor space to the indoor heat exchanger. Also, a defrost duct extending between the supply duct and the return duct between the indoor heat exchanger and the supply and return dampers. The defrost duct includes a defrost damper operable to control a defrost airflow through the defrost duct. In addition, in a defrost mode the four-way valve is operable to direct the refrigerant flow in the first direction through the outdoor heat exchanger to defrost the outdoor heat exchanger. Further, the supply damper, the return damper, and the defrost damper are operable to control the supply airflow, the return airflow, and the defrost airflow to flow between the supply duct, the return duct, and the indoor heat exchanger without substantially flowing into and substantially cooling the indoor space.

Other embodiments disclosed herein are directed to a HVAC system operable to use a refrigerant to heat or cool an indoor space and includes a compressor, an outdoor heat exchanger, an indoor heat exchanger, a bi-flow expansion device, and a four-way valve operable to flow the refrigerant through the bi-flow expansion device in a first direction in a cooling mode and in a second direction, opposite the first direction, in a heating mode. Additionally, the HVAC system includes a reheat coil positioned in line with an airflow passing across the indoor heat exchanger. Also, a three-way valve is positioned between the compressor and the four-way valve. When the HVAC system is in a defrost mode, the four-way valve is operable to direct the refrigerant flow in the first direction through the outdoor heat exchanger to defrost the outdoor heat exchanger. Further, the three-way valve is operable to flow at least a portion of refrigerant, which is warm and compressed, from the compressor to the reheat coil so that a supply airflow from the indoor heat exchanger to the indoor space is warmed.

Other embodiments disclosed herein are directed to a HVAC system operable to use a refrigerant to heat or cool an indoor space and including a compressor, an outdoor heat exchanger, an indoor heat exchanger, a bi-flow expansion device, and a four-way valve operable to flow the refrigerant in a refrigeration circuit through the bi-flow expansion device in a first direction in a cooling mode and in a second direction, opposite the first direction, in a heating mode. Additionally, the HVAC system includes a three-way valve located in the refrigeration circuit between the outdoor heat exchanger and the bi-flow expansion device. When the HVAC system is in a defrost mode, the four-way valve is operable to direct the refrigerant flow in the first direction through the outdoor heat exchanger to defrost the outdoor heat exchanger. Further, the three-way valve is operable to direct the refrigerant flow from the outdoor heat exchanger through a defrost return line and a defrost expansion device to the compressor and thereby bypass the bi-flow expansion device and the indoor heat exchanger.

Still other embodiments disclosed herein are directed to a method of defrosting a HVAC system operable to use a refrigerant to heat or cool an indoor space. The method includes compressing the refrigerant with a compressor, flowing warmed and compressed refrigerant from the compressor through a four-way valve and an outdoor heat exchanger to defrost the outdoor heat exchanger, and flowing a supply airflow across an indoor heat exchanger while not cooling the indoor space.

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, not all features of an actual implementation may be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

The present disclosure relates to heat pump heating, ventilating, and air conditioning ("heat pump HVAC", or more simply referred to herein as "HVAC") systems, and more particularly to systems and methods for defrosting the outdoor heat exchanger of HVAC systems. While a HVAC system is discussed, it should also be appreciated that the concepts are applicable to refrigeration systems as well.

Figure 1:
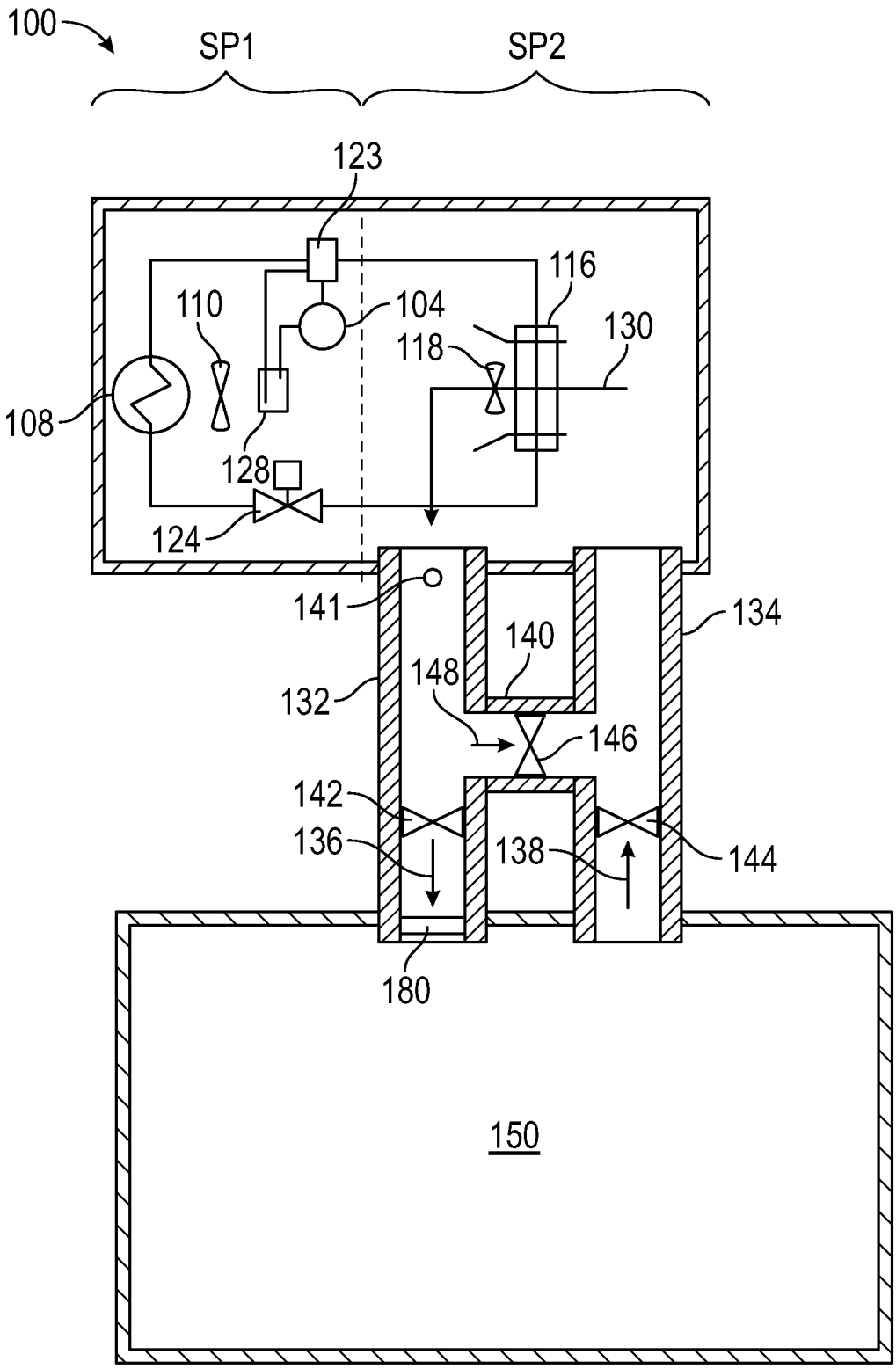
FIG. 1 is a schematic view of a system having a HVAC system connected to an indoor space, according to one or more embodiments.
Figure 2:
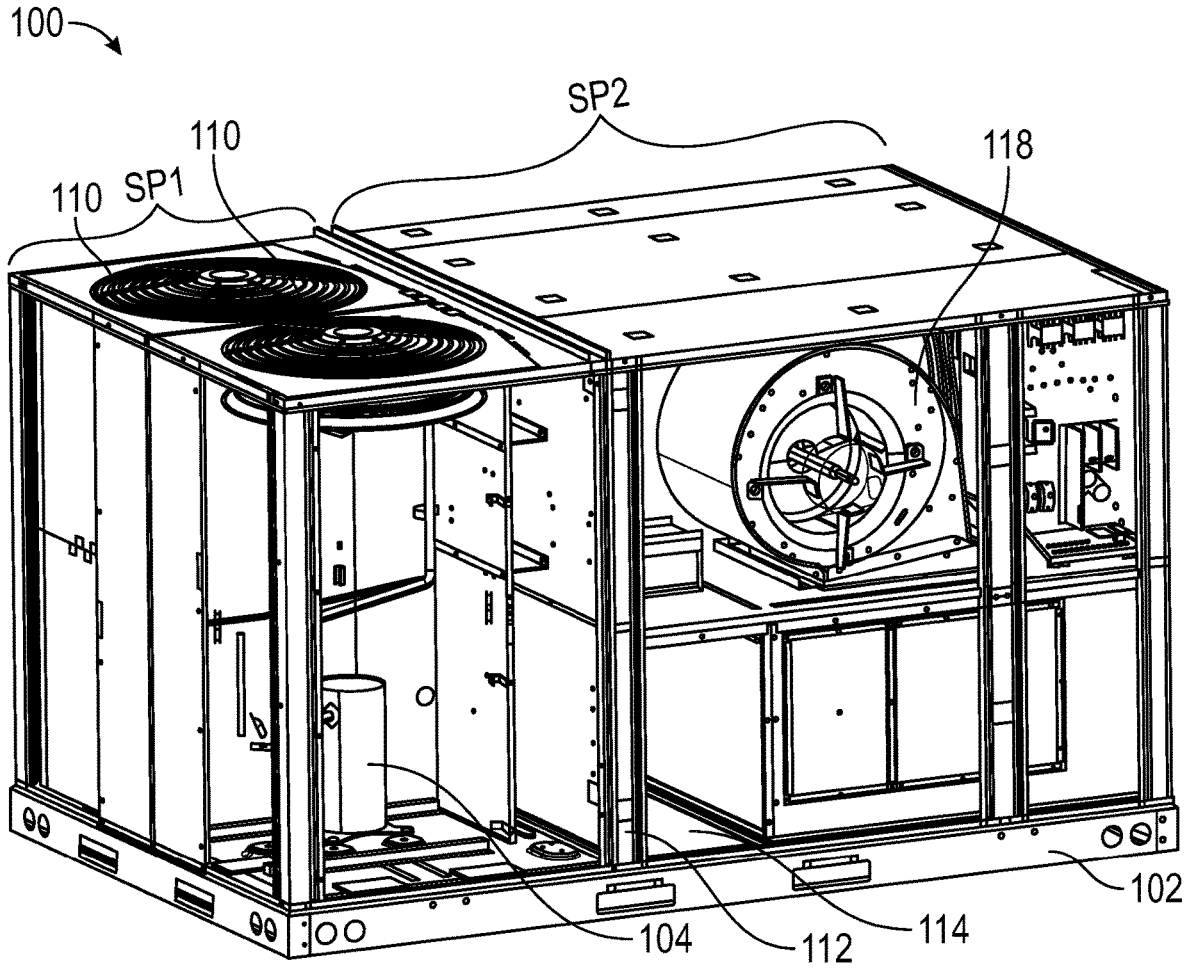
FIG. 2 is a partial isometric view of a HVAC system which may be used with the system of FIG. 1.
Figure 3:
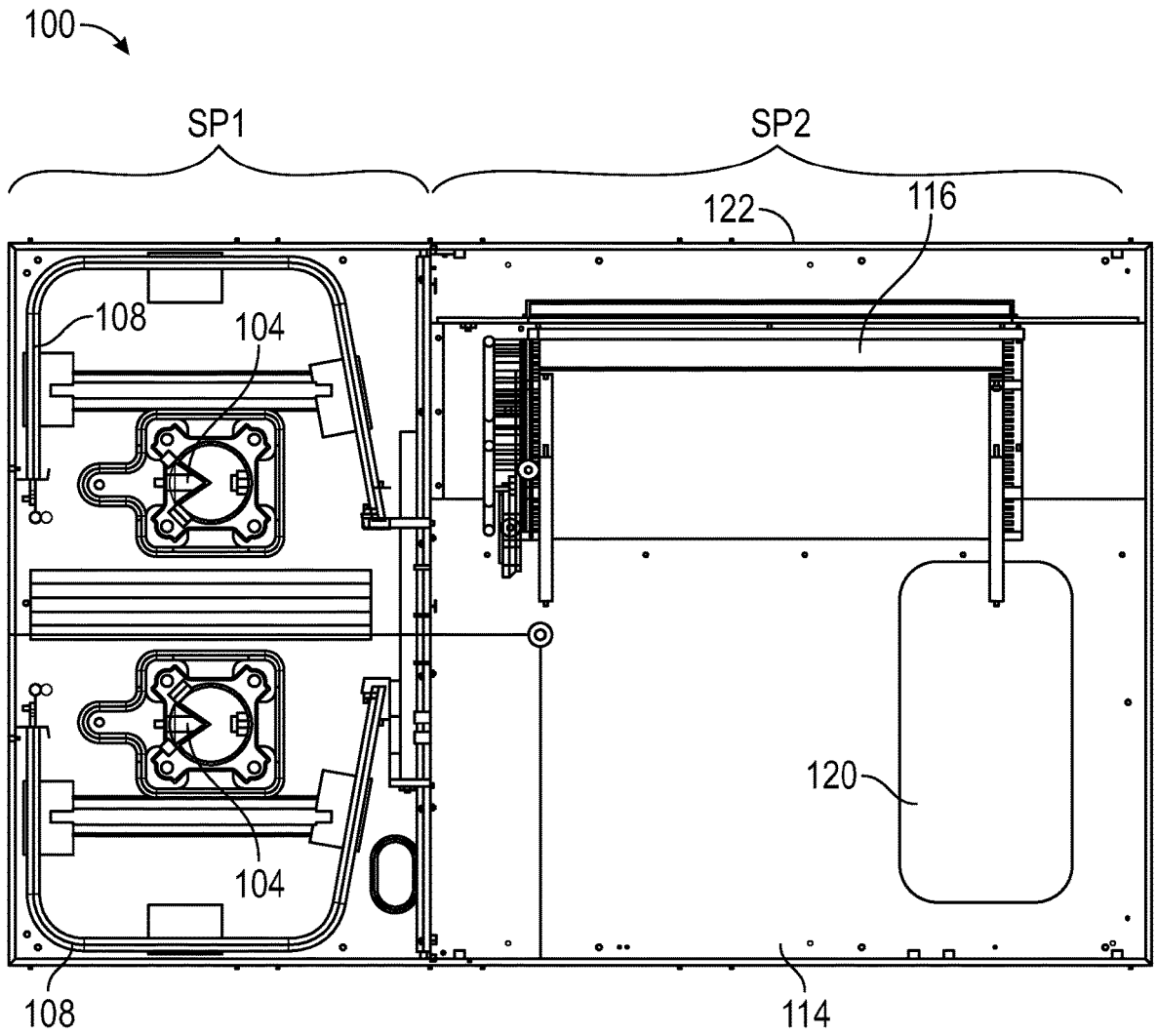
FIG. 3 is sectioned top view of the HVAC system of FIG. 2.

Referring now to FIGS. 1-3, a HVAC system 100 is shown in a schematic, partial isometric, and top view, respectively with some of the components of the HVAC system 100 removed for clarity. Although not shown in each of the drawings, it should be appreciated that the HVAC system 100 in FIGS. 2 and 3 includes additional components such as panel covers for covering and protecting the equipment of the HVAC system 100. The example HVAC system 100 is a so-called light commercial packaged rooftop unit and shall be described in terms of a cooling operation, although it should be appreciated that the HVAC system 100 could also be a heat pump and used for heating. Additionally, the HVAC system 100 may also represent residential packaged, residential split, light commercial split, or commercial applied applications as well as refrigeration system applications. The HVAC system 100 may be a variable refrigerant flow system with variable speed outdoor fans 110. As shown in FIGS. 2 and 3, the HVAC system 100 includes both an "outdoor" section SP1 and an "indoor" section SP2 mounted on a common frame 102. Further, the HVAC system 100 may be a variable refrigerant flow heat pump system.

The outdoor section SP1 includes one or more compressors 104, which may be any suitable type. (e.g., fixed speed, two speed, variable speed, fixed volume, variable volume, etc.) As noted above, the outdoor section SP1 may include other HVAC system components, such as but not limited to accumulators, receivers, charge compensators, flow control devices, air movers, pumps, and filter driers secured within and attached to the structure of the HVAC system 100. Also included are one or more outdoor heat exchangers 108 and outdoor fans 110 that move air into the outdoor section SP1, across the outdoor heat exchanger 108, and to the outside of the HVAC system 100. FIG. 1 is shown without the additional outdoor heat exchangers 108 and the outdoor fan 110, however, FIG. 2 shows a system with two fans 110, and FIG. 3 shows a system with two outdoor heat exchangers 108. The outdoor fans 110 may be any suitable type of fan, for example, a propeller fan. The outdoor heat exchangers 108 may include a plurality of heat-transfer tubes (not shown), in which a refrigerant flows, and a plurality of heat-transfer fins (not shown), in which air flows between gaps thereof. The plurality of heat-transfer tubes may be arranged in an up-down direction (herein referred to as "row direction"), and each heat-transfer tube may extend in a direction substantially orthogonal to the up-down direction (in a substantially horizontal direction). At an end portion of the outdoor heat exchangers 108, for example, the heat-transfer tubes are connected to each other by being bent into a U-shape or by using a U-shaped return bends so that the flow of a refrigerant from a certain column to another column and/or a certain row to another row is turned back. The plurality of heat-transfer fins that extend, so as to be oriented in the up-down direction, are arranged side by side with a predetermined interval between the plurality of heat-transfer fins. The plurality of heat-transfer fins and the plurality of heat-transfer tubes are assembled to each other so that each heat-transfer fin extends through the plurality of heat-transfer tubes. The plurality of heat-transfer fins may also be disposed in a plurality of columns.

Due to the structure of the outdoor heat exchangers 108, operation of the outdoor fans 110 draws a flow of outdoor air into the outdoor section SP1 and passes through the outdoor heat exchangers 108. As the outdoor air passes through the outdoor heat exchanger 108 the outdoor air exchanges thermal energy with the refrigerant that flows in the outdoor heat exchangers 108. After the thermal energy exchange in the outdoor heat exchanger 108, the air is then also discharged to the outside of the outdoor section SP1 by the outdoor fans 110. Even though the heat exchanger 108 is described as a round tube and plate fin heat exchanger, other heat exchanger types, such as for instance a microchannel heat exchanger, are within the scope of the disclosure.

The outdoor section SP1 and the indoor section SP2 are separated by a partition plate 112. Outdoor air flows to the outdoor section SP1 and indoor air flows to the indoor section SP2. By separating the outdoor section SP1 and the indoor section SP2 by the partition plate 112, the airflow bypass between the outdoor section SP1 and the indoor section SP2 is blocked. Therefore, in an ordinary state, the indoor air and the outdoor air do not mix and do not communicate with each other within or via the HVAC system 100. It has to be noted, that there exist the airside economizers that allow mixing indoor and outdoor air, however there are not discussed in relation to this disclosure.

The indoor section SP2 also includes an indoor heat exchanger 116 and an indoor blower 118, which may be, for example, a centrifugal fan. The indoor section SP2 may also optionally include a combustion heat exchanger (not shown). The indoor heat exchanger 116 may also include a plurality of heat-transfer tubes, in which a refrigerant flows, and a plurality of heat-transfer fins, in which air flows between gaps thereof. The plurality of heat-transfer tubes may be arranged in an up-down direction (row direction), and each heat-transfer tube may extend in a direction substantially orthogonal to the up-down direction. At an end portion of the indoor heat exchanger 116, for example, the heat-transfer tubes are connected to each other by being bent into a U-shape or by using a U-shaped return bends so that the flow of a refrigerant from a certain column to another column and/or a certain row to another row is turned back. The plurality of heat-transfer fins and the plurality of heat-transfer tubes may be assembled so that each heat-transfer fin extends through the plurality of heat-transfer tubes. Although the heat exchanger 116 is described as a round tube and plate fin heat exchanger, other heat exchanger types, such as for instance a microchannel heat exchanger, are within the scope of this disclosure.

The indoor heat exchanger 116 divides the indoor section SP2 into a space on an upstream side with respect to the indoor heat exchanger 116 and a space on a downstream side with respect to the indoor heat exchanger 116. All air that flows to the downstream side from the upstream side with respect to the indoor heat exchanger 116, passes through the indoor heat exchanger 116. The indoor blower 118 is disposed in the space on the downstream side with respect to the indoor heat exchanger 116 and causes a blower airflow 130 that passes through the indoor heat exchanger 116 to be generated. As shown in FIG. 1, a supply duct 132 is connected downstream from heat exchanger 116, and a return duct 134 is connected upstream from the heat exchanger 116. In this manner a loop or circuit is formed whereby air passes in a cycle between the indoor heat exchanger 116 and an indoor space 150 by passing from the blower airflow 130, to a supply airflow 136, to the indoor space 150, and to a return airflow 138 that leads back to the indoor heat exchanger 116. Although not specifically shown in FIG. 3, supply duct 132 may attach to supply air opening 120, while return duct 134 may attach to a return air opening 122, each via a bottom plate 114 in the bottom of the HVAC system 100 (note that the side air supply and discharge are also feasible). Alternatively, the horizontal, instead of downward, supply and return air ducts can be provided, and the down-shot air duct configurations are also within the scope of the disclosure. The blower 118 is disposed above the supply air opening 120 in the bottom plate 114 for providing supply air to the indoor space or environment being conditioned.

Referring to FIG. 1, the HVAC system 100 also includes a refrigerant circuit that recirculates a refrigerant between the indoor heat exchanger 116 and the outdoor heat exchangers 108. When in a cooling operation or a heating operation, the refrigerant circuit circulates a refrigerant to perform a vapor compression refrigeration cycle, whereby heat is exchanged at the indoor heat exchanger 116 and at the outdoor heat exchangers 108. The refrigerant circuit includes the compressor 104, the outdoor heat exchanger 108, the indoor heat exchanger 116, a configurable 4-way valve 123, a bi-flow expansion device 124, and an accumulator 128. The refrigerant circuit may also include a filter drier.

In a cooling mode, the refrigerant is compressed by the compressor 104 and is sent through the four-way valve 123 to the outdoor heat exchangers 108. The refrigerant dissipates heat to outdoor air at the outdoor heat exchangers 108 and is sent to the bi-flow expansion device 124 (it has to be noted that a bi-flow expansion device can be replaced by two sets of unidirectional expansion devices complemented by internal or external check valves). At the bi-flow expansion device 124, the refrigerant expands and its pressure and temperature are reduced. The refrigerant then flows to the indoor heat exchanger 116. A refrigerant having a low temperature and a low pressure sent from the bi-flow expansion device exchanges heat at the indoor heat exchanger 116, absorbing heat from indoor air. The air cooled by having its heat taken away at the indoor heat exchanger 116 is supplied to the indoor space 150 or environment being conditioned. The refrigerant after the heat exchange at the indoor heat exchanger 116 is evaporated into a gaseous state and then travels back through the four-way valve 123, to the accumulator 128, and is then sucked back into the compressor 104 to repeat the cycle. Thus, in a cooling mode, the indoor heat exchanger 116 operates as an evaporator.

In a heating mode, the refrigerant is compressed by the compressor 104 and is sent through the four-way valve 123 to the indoor heat exchanger 116. The refrigerant dissipates heat to indoor air at the indoor heat exchanger 116 and is sent to the bi-flow expansion device 124. At the bi-flow expansion device 124, the refrigerant expands and its pressure and temperature are reduced. The refrigerant then flows to the outdoor heat exchangers 108. A refrigerant having a low temperature and a low pressure sent from the bi-flow expansion device 124 exchanges heat at the outdoor heat exchanger 108, absorbing heat from the outdoor air. The refrigerant after the heat exchange at the outdoor heat exchangers 108 is evaporated into a gaseous state and then travels back through the four-way valve 123, to the accumulator 128, and is then sucked back into the compressor 104 to repeat the cycle. Thus, in a heating mode, the outdoor heat exchanger 108 operates as an evaporator. Concurrently with the refrigeration cycle described above, air is also circulated in a cycle between the indoor heat exchanger 116 and the indoor space 150, such that heat from the refrigeration cycle is transferred into the indoor space 150. In particular, the blower airflow 130 is heated by heat exchange with the indoor heat exchanger 116, is supplied via supply duct 132 and supply airflow 136 to the indoor space 150 being heated, and the return airflow 138 returns along return duct 134 to the indoor heat exchange 116 of HVAC system 100.

The equipment of the refrigerant circuit, and thus flow of the refrigerant through the circuit may be controlled by a main controller (e.g., such as controller 400 of FIG. 6 discussed latter herein) that controls the HVAC system 100. The main controller may also be configured to be capable of communicating with a remote controller. A user can send, for example, a set values of indoor temperatures of rooms in the indoor space 150 being conditioned to the main controller from the remote controller. For controlling the HVAC system 100, a plurality of temperature sensors for measuring the temperature of a refrigerant at each portion of the refrigerant circuit and/or a pressure sensor that measures the pressure of each portion and/or temperature sensors (e.g., such as a supply air temperature sensor 141) for measuring the air temperatures within the supply ducts 132 and/or the return ducts 134 may be used.

The main controller performs at least on/off control of the compressors 104, on/off control of the outdoor fans 110, and on/off control of the indoor blower 118. In addition, when motors within the system are variable speed motors, (e.g., motor(s) for the compressor(s) 104, the outdoor fan(s) 110, and the indoor blower(s) 118), the controller may be configured to individually control the speed of each motor. In this manner, the rate of heat exchange of the HVAC system 100 may be controlled by controlling the blower 118 motor rotational speed thereby controlling the flow rate of the blower airflow 130 across the indoor heat exchanger 116. Similarly, the rate of heat exchange of the HVAC system 100 may be controlled by controlling the compressor 104 motor thereby controlling the flowrate of refrigerant in the refrigerant circuit.

The main controller may be realized by, for example, a computer. The computer that constitutes the main controller includes a control calculation device and a storage device. For the control calculation device, a processor such as a CPU or a GPU may be used. The control calculation device reads a program that is stored in the storage device and performs a predetermined image processing operation and a computing processing operation in accordance with the program. Further, the control calculation device writes a calculated result to the storage device and reads information stored in the storage device in accordance with the program. However, the main controller may be formed by using an integrated circuit (IC) that can perform control similar to the control that is performed by using a CPU and a memory. Here, IC includes, for example, LSI (large-scale integrated circuit), ASIC (application-specific integrated circuit), a gate array, and FPGA (field programmable gate array).

In some embodiments, the bi-flow expansion device 124 may be a thermal expansion valve ("TXV") or a fixed-orifice expansion valve. When the bi-flow expansion device 124 is a TXV, the TXV is controlled using a temperature sensing bulb and an equalizer line (not shown) that may be connected to the refrigerant circuit at a position downstream of the sensing bulb. The temperature sensing bulb may be placed on a compressor suction line upstream from the compressor 104 and downstream of the four-way valve 123, with respect to the refrigerant flow. If the accumulator 128 is used, the bulb may be placed in the compressor suction line upstream or downstream of the accumulator 128, with respect to the refrigerant flow. In this manner, the output of the sensing bulb is adjusted to account for the amount of liquid refrigerant within the accumulator 128. The location of the sensing bulb may be selected to optimize vapor compression refrigeration cycle, depending on user preferences for the HVAC system 100. Additionally, the HVAC system 100 may include an equalization line (not shown) in communication with the pressures in the indoor heat exchanger 116 and the outdoor heat exchanger 108. In cooling mode for example, the indoor heat exchanger 116 is the evaporator and the pressure of the refrigerant leaving the indoor heat exchanger 116 is communicated to the TXV through the equalizer line. Pressure communicated through the equalizer line may be used to balance the pressure communicated to the bi-flow expansion device 124 from the sensing bulb to operate the TXV. The TXV may be set to maintain a compressor superheat while optimizing whichever of the indoor heat exchanger or outdoor heat exchanger is operating as the evaporator. Controlling the TXV with this method allows the evaporator superheat to be maintained at more efficient levels. Further, the expansion device 124 may include an internal bleed port to maintain a more accurate and stable control, as well as equalize the high side pressure and low side pressure during the off-cycle. Further, the TXV may also be a so-called balanced port design with the pressure of the refrigerant at the condenser balanced across the valve.

If the accumulator 128 is used in the compressor suction line (e.g., line downstream from the compressor 104), the accumulator 128 allows for the collection of some refrigerant, before the refrigerant flows to the compressor 104. This provides the benefit of separating some non-vaporized refrigerant before passing to the compressor 104. Further, the bi-flow expansion device 124 is also configurable to control the flow of refrigerant to store some refrigerant in the accumulator 128 if there is a refrigerant charge imbalance in the refrigeration circuit. In doing so, the bi-flow expansion device 124 may be configured to lower a superheat of the evaporator, which in the cooling mode is the indoor heat exchanger 116, compared to not including the accumulator in the HVAC system 100. This allows a lower capacity evaporator to be used for the load of the HVAC system 100. As an example, the bi-flow expansion device 124 is configurable to control flow of the refrigerant through the evaporator such that a superheat of the evaporator is as close to zero as possible while maintaining a superheat control at the compressor 104.

In addition, in some embodiments, the bi-flow expansion device 124 may be an electronic expansion valve ("EXV"), and a pair of temperature or temperature/pressure sensors (not shown) may be connected to a main controller (e.g., such as controller 400 of FIG. 6 discussed latter herein) to provide measurement data for the control of the EXV bi-flow expansion device 124 operation. The temperature and/or pressure sensors are positioned to sense temperature and/or pressure in the compressor suction line and/or the accumulator 128 upstream of the compressor 104 and downstream of the four-way valve 123. The main controller (e.g., such as controller 400 of FIG. 6) processes the measurement data and provides control commands to the EXV bi-flow expansion device 124 to operate the HVAC system 100 similarly to the TXV operation discussed above.

Referring again to FIG. 1, the HVAC system 100 further includes a defrost duct 140 connected between the supply duct 132 and the return duct 134 that provides a path for a defrost airflow 148. In this manner a second loop or circuit is formed for the blower airflow 130. To regulate the proportions of air that pass within ducts 132, 134, 140 as airflows 136, 138, 148, the HVAC system 100 further includes a supply damper 142, a return damper 144, and a defrost damper 146, contained within the ducts 132, 134, 140, respectively. The dampers 142, 144, 146 may be actuated individually and are each adjustable between a closed and an open position, including positions therebetween. Thus, the dampers 142, 144, 146 may be positioned as partially closed. The terms partially open and partially closed may describe the same absolute position of the dampers 142, 144, 146, unless otherwise stated explicitly or by context, however each term may also be descriptive of the movement direction of the damper. For example, a partially open damper may be in the process of opening (e.g., transitioning away from a closed position). Similarly, a partially closed damper may be in the process of closing (e.g., transitioning away from an open position).

Referring still to FIG. 1, when in heating mode, the HVAC system 100 may be configured such that the supply damper 142 and the return damper 144 are in an open position, while the defrost damper 146 is in a closed position. In this manner substantially all of the blower airflow 130 would be directed into the indoor space 150, thus providing the maximum amount of heating to occupants therein. In the manner previously described, when the HVAC system 100 is operating in heating mode, the outdoor heat exchanger 108 is an evaporator that is on the "cold" side of the refrigeration cycle. However, a cold outdoor heat exchanger 108 operating in a cold environment presents the problem of ice formation on the outdoor heat exchanger 108. To defrost ice on the outdoor heat exchanger 108, the HVAC system 100 may be configured to reverse the refrigeration cycle in a defrost mode, whereby the indoor heat exchanger 116 would be operable as the evaporator, and thus placing the outdoor heat exchanger 108 onto the "hot" side of the refrigeration cycle as a condenser. In particular, this is accomplished by actuating the four-way valve 123 to flow refrigerant to the outdoor heat exchanger 108 and then through the bi-flow expansion device 124, and through the indoor heat exchanger 116. In this manner the HVAC system 100 is operable to flow a refrigerant through the bi-flow expansion device 124 in a first direction in the cooling mode or defrost mode and configurable such that the compressor 104 is operable to flow the refrigerant through the bi-flow expansion device 124 in a second direction, opposite the first direction, in the heating mode.

However, reversing the refrigeration cycle and placing the indoor heat exchanger 116 on the "cold side" of the refrigeration cycle is not desirable with regards to the continued need of heating the indoor space 150. In particular, the blower air flow 130 would be cooled as it passes across the indoor heat exchanger 116 and thus the indoor space 150 would also be cooled when operating in the defrost mode. Thus, to maintain a comfortable temperature for the occupants within the indoor space 150 during the defrost mode, the dampers 142, 144, 146 are positionable to regulate the amount of cold air that passes from the blower airflow 130 into the indoor space 150. For example, the defrost mode may include configuring the supply damper 142 and the return damper 144 to a closed position, while configuring the defrost damper 146 to an open position. In this manner substantially all of the blower airflow 130 would be directed as the defrost airflow 148 within the defrost duct 140, thereby bypassing the indoor space 150, and thus not substantially changing the temperature of the indoor space 150. Additionally, the indoor blower 118 may be configured to provide a minimum amount of airflow in the defrost mode to prevent nuisance trips of the compressor 104.

Optionally, the defrost mode may include configuring the supply damper 142 and the return damper 144 to a partially closed position, while configuring the defrost damper 146 to an open or partially open position. In this manner some of the supply airflow 136 and some of the return airflow 138 would be allowed to circulate through the indoor space 150, while also directing some air flow as defrost airflow 148 within the defrost duct 140. Such a configuration might be used to direct most of the blower airflow 130 along the defrost duct 140, thereby making a minimal impact to the temperature of the indoor space 150, while also maintaining a minimum required airflow into the indoor space 150. Such a minimum required airflow into the indoor space 150 may be set by numerous external factors that are removed from the operational requirements of the HVAC system 100. (e.g., such as due to safety regulations, third party equipment operating within indoor space, etc.) The minimum airflows 136, 138 may be negligible and thus may not significantly change the temperature of the indoor space 150. However, the HVAC system 100 may further include a coil 180 (e.g., an electric coil, hot gas reheat coil, combustion heater, hydronic heater, etc.) placed downstream of the supply damper 142 such that supply airflow 136 may be heated before entering the indoor space 150. Optionally, the supply air temperature sensor 141 may be placed within the supply airflow 136 to monitor the temperature of the supply airflow 136 and may be used with a controller (e.g., controller 400 of FIG. 6) to control the operation of the coil 180 and the dampers 142, 144, 146. For example, when the temperature of the supply airflow 136 drops below a set point, the controller 400 can operate the coil 180 to increase the temperature of the supply airflow 136 before entering the indoor space 150. Optionally, the temperature measurement from the supply air temperature sensor 141 can also be used by the controller 400 to configure the supply damper 142 and the return damper 144 to a partially closed position. For some power outputs of the coil 180, restricting the supply airflow 136 across the coil 180 may more effectively raise the temperature of the air entering the indoor space 150.

Figure 4:
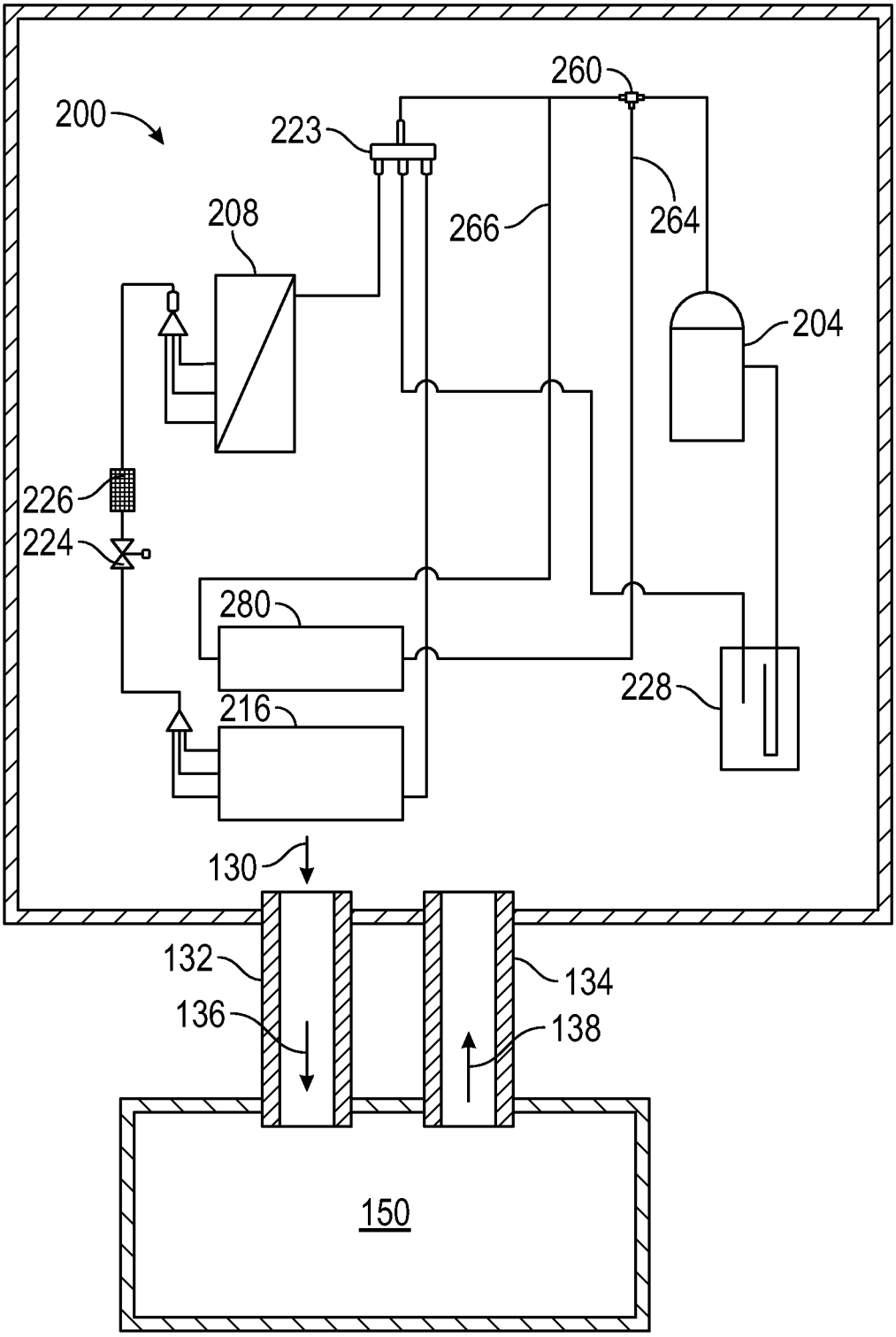
FIG. 4 is a schematic view of another system having a HVAC system connected to an indoor space, according to one or more embodiments.

Referring to FIG. 4, another embodiment of an HVAC system 200 is shown. Generally speaking, some of the components and refrigeration circuit of the HVAC system 200 are similar to the components and refrigerant circuit of the HVAC system 100, and thus the same or similar reference numerals are used. In addition, the operational description is not repeated in the interest of brevity, but instead will focus on features of the HVAC system 200 that are different from the HVAC system 100. In particular, the refrigeration circuit of the HVAC system 200 comprises a compressor 204, a four-way valve 223, an outdoor heat exchanger 208, a filter drier 226, a bi-flow expansion device 224, an indoor heat exchanger 216, and an accumulator 228, each connected as a refrigeration circuit as described previously for the HVAC system 100. In addition, the HVAC system 200 further includes a three-way valve 260 placed in the circuit before the four-way valve 223 and downstream of the compressor 204, and a reheat coil 280 placed in fluid communication with the circuit downstream of the compressor 204 via the three-way valve 260. It has to be noted that a three-way valve can be replaced by a pair of conventional valves to perform the same function.

The three-way valve 260 may be a controllable valve that can vary its two outputs individually between an open position, a closed position, and positions therebetween. Thus the three-way valve 260 may be selectively operable to flow none, some, or all of the refrigerant from the compressor 204 to the reheat coil 280, while directing the balance of the refrigerant flow from the compressor 204 directly to the four-way valve 223. When directing flow to the reheat coil 280, refrigerant flows from the compressor 204, through the three-way valve 260, through a refrigerant line 264, through the reheat coil 280, through a refrigerant line 266, and through the four-way valve 223.

Reheat coil 280 is a heat exchanger and may be similar in structure to heat exchangers 108, 116 previously described. The reheat coil 280 is positioned on the "hot" side of the refrigeration cycle, given that it is configured to receive high pressure and hot gas from the compressor 204. In addition, the reheat coil 280 is placed within the blower airflow 130, such that temperature of the blower airflow 130 may be conditioned by both the indoor heat exchanger 216 and the reheat coil 280.

Optionally, the HVAC system 200 also include the refrigerant filter drier 226 located within the refrigeration circuit. The filter drier 226 is shown located between the bi-flow expansion device 224 and the outdoor heat exchanger 208, but the filter drier 226 may be located in another portions of the refrigeration circuit, depending on the desired operation of the HVAC system 200 and on the proper refrigerant charge rebalancing between the cooling and heating mode of operation. The filter drier 226 functions to filter particulate contamination, copper shavings, and to capture any moisture present in the refrigerant circuit, thus drying the refrigerant.

Referring still to FIG. 4, when in heating mode the HVAC system 200 is configured such that the outdoor heat exchanger 208 is an evaporator that is on the "cold" side of the refrigeration cycle. This combination of a cold outdoor heat exchanger 208 that is operating in a cold environment thus presents the problem of ice formation on the outdoor heat exchanger 208. To defrost this ice on the outdoor heat exchanger 208, the HVAC system 200 may be configured to reverse the refrigeration cycle in a defrost mode, whereby the indoor heat exchanger 216 would be operable as the evaporator, and thus placing the outdoor heat exchanger 208 onto the "hot" side of the refrigeration cycle as a condenser. In particular, this is accomplished by actuating the four-way valve 223 to flow refrigerant to the outdoor heat exchanger 208 and then through the filter drier 226, through the bi-flow expansion device 224, and through the indoor heat exchanger 216. In this manner the HVAC system 200 is operable to flow a refrigerant from the compressor 204 and through the bi-flow expansion device 224 in a first direction in the cooling mode or defrost mode and configurable such that the compressor 204 is operable to flow the refrigerant from the compressor 204 and through the bi-flow expansion device 224 in a second direction, opposite the first direction, in the heating mode. In addition, to maintain a comfortable temperature for the occupants within the indoor space 150 during the defrost mode, the three-way valve 260 is selectively operated to flow some or all of the refrigerant from the compressor 204 to the reheat coil 280. In this manner, the blower airflow 130 that is cooled passing across the indoor hear exchanger 216 is then reheated passing across the reheat coil 280, thus resulting in no or minimal temperature change. As before, the indoor blower 118 may be configured to provide a minimum amount of airflow in the defrost mode of operation to prevent nuisance trips of the compressor 204.

Referring to FIGS. 1 and 4, the reheat coil 280 and the three-way valve 260 may be used in combination with the supply damper 142, the return damper 144, and the defrost damper 146 and defrost duct of the HVAC system 100 as shown in FIG. 1. For example, the reheat coil 280 may be used in place of the coil 180, thus avoiding the use of electric coils or combustion elements within the coil 180. Optionally, the reheat coil 280 may be used together with the coil 180. For example, the reheat coil 280 and the coil 180 may both be placed between the supply damper 142 and the indoor space 150, such that the supply airflow 136 is warmed sequentially by both coils 180, 280. In this manner, the electrical requirements of the coil 180 could be reduced, as compared to options only using the coil 180. Also, the reheat coil 280 may be placed at other positions within the HVAC system 100 (e.g., within the indoor section SP2 and upstream of the supply duct 132). While operating the reheat coil 280 and or the coil 180 in the defrost mode, the controller 400 (FIG. 6) may also be used to control the dampers 142, 144, 146 to control the amount of the supply air flow 136 entering into the indoor space 150. By controlling the amount of the supply air flow 136, the amount of heat input from the coils 180, 280 is controlled, and thus the temperature of the supply air flow 136 is controlled. In particular, the controller 400 can configure the supply damper 142 and the return damper 144 to a partially closed position, while configuring the defrost damper 146 to an open or partially open position. In this manner some or most of the blower airflow 130 would pass into the defrost airflow 148, and would thus recirculate to the indoor heat exchanger 116 without changing the temperature of the indoor space 150. Then the remaining blower airflow 130 would pass the supply damper 142 as the supply airflow 136, and would then be heated by the reheat coil 280 and or coil 180 before entering the indoor space 150.

Figure 5:
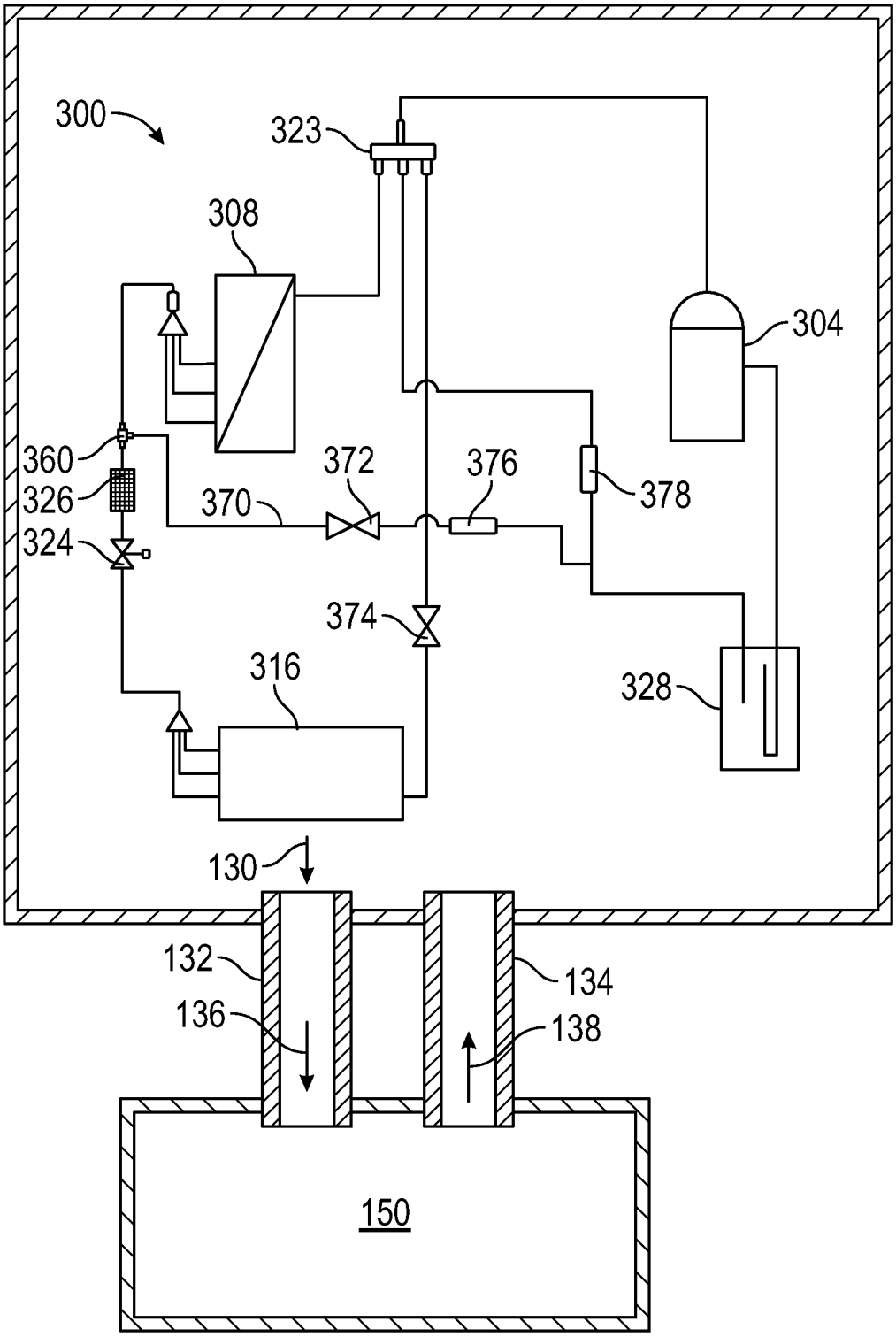
FIG. 5 is a schematic view of another system having a HVAC system connected to an indoor space, according to one or more embodiments.

Referring now to FIG. 5, an HVAC system 300 is shown that may be used in place of the HVAC system 100 previously described. Generally speaking, some of the components and refrigeration circuit of the HVAC system 300 are similar to the components and refrigerant circuit of the HVAC system 100, and thus the same or similar reference numerals are used. In addition, the operational description is not repeated in the interest of brevity, but instead will focus on features of the HVAC system 300 that are different from the HVAC system 100. In particular, the refrigeration circuit of the HVAC system 300 comprises a compressor 304, a four-way valve 323, an outdoor heat exchanger 308, a bi-flow expansion device 324, an indoor heat exchanger 316, and an accumulator 328 each connected as a refrigeration circuit as described previously for the HVAC system 100. In addition, the HVAC system 300 further includes a three-way valve 360 placed in the circuit between the outdoor heat exchanger 308 and the bi-flow expansion device 324, a defrost return line 370 extending from the three-way valve 360 to the accumulator 328, and a defrost expansion device 372 positioned along the defrost line 370. Once again, three-way valve 360 can be replaced by a pair of conventional solenoid valves to perform the same function.

The three-way valve 360 is a controllable valve that can vary its two outputs individually between open position, a closed position, and positions therebetween. Thus the three-way valve 360 is selectively operable to flow none, some, or all of the refrigerant flow from the outdoor heat exchanger 308 into the defrost expansion device 372, while directing the balance of the refrigerant flow to the bi-flow expansion device 324.

Optionally, the HVAC system 300 may also include a refrigerant filter drier 326, which operates in same manner as discussed above on the HVAC system 100. The filter drier 326 is positioned between the outdoor heat exchanger 308 and the bi-flow expansion device 324, however the filter drier 326 may also be positioned between the indoor heat exchanger 316 and the bi-flow expansion device 324 or at any other location along the refrigerant circuit.

Optionally, the HVAC system 300 may also include a solenoid valve 374 positioned between the indoor heat exchanger 316 and the four-way valve 323, a defrost check valve 376 positioned between the defrost expansion device 372 and the accumulator 328, and a return check valve 378 positioned between the four-way valve 323 and the accumulator 328. The solenoid valve 374 may be an adjustable valve that can be varied between open position, a closed position, and positions therebetween.

Referring still to FIG. 5, when in heating mode, the HVAC system 300 is configured such that the outdoor heat exchanger 308 is an evaporator that is on the "cold" side of the refrigeration cycle. This combination of a cold outdoor heat exchanger 308 that is operating in a cold environment, thus presents the problem of ice formation on the outdoor heat exchanger 308. To defrost this ice on the outdoor heat exchanger 308, the HVAC system 300 may be configured to reverse the refrigeration cycle in a defrost mode, thereby placing the outdoor heat exchanger 308 on the "hot" side of the refrigeration cycle as a condenser.

During this defrost mode, the indoor heat exchanger 316 is isolated from the refrigerant circuit such that substantially no refrigerant flows through the bi-flow expansion device 324 or through the indoor heat exchanger 316. In this manner, the outdoor heat exchanger 308 may be defrosted of ice without also cooling the blower airflow 130 that passes across the indoor heat exchanger 316. The defrost mode is engaged by actuating the four-way valve 323 to flow refrigerant from the compressor 304 to the outdoor heat exchanger 308 and by actuating the three-way valve 360 to direct refrigerant flow from the outdoor heat exchanger 308 along the defrost return line 370. The refrigerant then flows through the defrost expansion device 372 and then flows back to the accumulator 328 to restart the refrigeration cycle, thus by-passing the indoor heat exchanger 316. At the defrost expansion device 372, the refrigerant expands and its pressure and temperature are reduced. The expansion device 372 may operate similarly to the bi-flow expansion device 324 and may be an EXV or TXV as previously described. The pressure reduction of the refrigerant by the expansion device 372 allows the compressor 304 to output an approximately constant pressure to the refrigerant circuit during the defrost mode. During the defrost mode, the four-way valve 323 also blocks refrigerant flow between the indoor heat exchanger 316 and the accumulator 328. In this manner, the indoor heat exchanger 316 is isolated from the refrigerant circuit via the four-way valve 323 and the three-way valve 360.

Components other than the four-way valve 323 may also be used to isolate the indoor heat exchanger 316 during the defrost mode. For example, the solenoid valve 374 may be fully closed during the defrost mode or may be selectively opened during the defrost mode, thus providing selective isolation for the indoor heat exchanger 316. By selectively opening the solenoid valve 374, refrigerant imbalances can be adjusted within the refrigerant circuit by storing and or releasing refrigerant from the indoor heat exchanger 316.

By isolating the indoor heat exchanger 316, the HVAC system 300 is operable to use the heat of compression added to the refrigerant by the compressor 304 to defrost ice on the outdoor heat exchanger 308. Placing the outdoor heat exchanger on the "hot side" of the refrigeration cycle would normally by default place the indoor heat exchanger 316 on the "cold side" of the refrigeration cycle. However, it is not desirable to cool the indoor space 150 during cold weather. By isolating the indoor heat exchanger 316, the refrigerant by-passes the bi-flow expansion device 324, by-passes the indoor heat exchanger 316, and thus avoids providing cooling to the indoor space 150 via the blower airflow 130.

When the defrost expansion device 372 is an EXV, a pair of temperature or temperature/pressure sensors (not shown) may be connected to a main controller (e.g., such as controller 400 of FIG. 6) to control the defrost expansion device 372 and the solenoid valve 374. The temperature and/or pressure sensors may be positioned to sense temperature and/or pressure in the compressor suction line and/or the accumulator 328 upstream of the compressor 304 and downstream of the four-way valve 323. The main controller 400 processes the measurement data from the sensors and provides control commands to the defrost expansion device 372 and the solenoid valve 374 to operate the HVAC system 300 based on the measurement data.

Optionally, the check valves 376, 378 serve as both backflow prevention and as a backup sealing for the three-way valve 360 along the defrost line 370 and for the solenoid valve 374. Such sealing may be advantageous when the HVAC system 300 is operating in other modes (e.g., cooling mode or heating mode) and reducing backflow within the defrost return line 370 and between the accumulator 328 and the indoor heat exchanger 316, may improve the HVAC system 300 control when switching between the cooling, heating, and defrost modes of operation.

The HVAC system 300 of FIG. 5 may be used in combination with the supply damper 142, the return damper 144, and the defrost damper 146 and defrost duct of the HVAC system 100 as shown in FIG. 1. When the HVAC system 300 operates in the defrost mode, the refrigerant by-passes the indoor heat exchanger 316 and the bi-flow expansion device 324, and thus avoids providing cooling to the indoor heat exchanger 316 and to the indoor space 150. When the blower airflow 130 continues pass air through the indoor heat exchanger 316 the latent heat, which remains from the heating mode operation, is delivered into the indoor space 150. However, during extended durations of the defrost mode, the latent heat from the indoor heat exchanger 316 can be depleted and recirculation of the blower airflow 130 into the indoor space 150 may not be desirable for the comfort of occupants therein. Thus, during the defrost mode, the supply damper 142 and the return damper 144 can optionally be closed or partially closed, while the defrost damper 146 can optionally be opened or partially opened. In this manner some or most of the blower airflow 130 would pass into the defrost airflow 148, and would thus recirculate to the indoor heat exchanger 116, while also regulating the amount of the supply air flow 136 into the indoor space 150. By diverting some or all of the blower airflow 130, the amount of supply airflow 136 into indoor space 150 can be regulated while the indoor blower 118 continues to operate at the speed used in a prior HVAC system 300 control mode (e.g., heating mode). By not adjusting the speed of the indoor blower 118, the control of the indoor blower 118 may be simplified during the defrost mode. By configuring the supply damper 142 and the return damper 144 to a partially closed position, while configuring the defrost damper 146 to an open or partially open position, a minimum air flow into the indoor space 150 is maintained. However, the speed of the indoor blower 118 may also be reduced to reduce the power consumption of the HVAC system 300.

Figure 6:
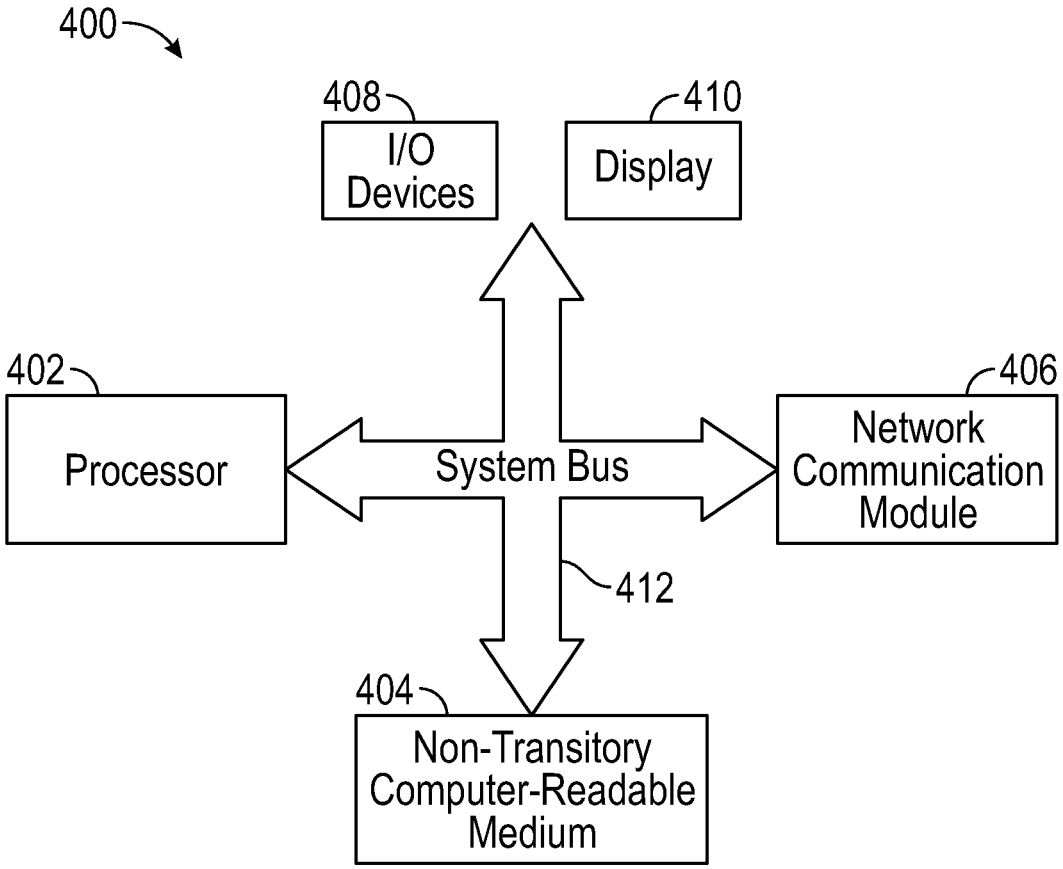
FIG. 6 is a block diagram of a controller, according to one or more embodiments.

Referring to FIG. 6, a block diagram of a controller 400 that can be used to control the blower(s) and the compressor (s) of an HVAC system, such as in the control systems described above for HVAC systems 100-300. The controller 400 includes at least one processor 402, a non-transitory computer readable medium 404, an optional network communication module 406, optional input/output devices 408, a data storage drive or device, and an optional display 410 all interconnected via a system bus 412. In at least one embodiment, the input/output device 408 and the display 410 may be combined into a single device, such as a touch-screen display. Software instructions executable by the processor 402 for implementing software instructions stored within the controller 400 in accordance with the illustrative embodiments described herein, may be stored in the non-transitory computer readable medium 404 or some other non-transitory computer-readable medium.

Although not explicitly shown in FIG. 6, it should be recognized that the controller 400 may be connected to one or more public and/or private networks via appropriate network connections. It will also be recognized that software instructions may also be loaded into the non-transitory computer readable medium 404 from an appropriate storage media or via wired or wireless means.

Certain terms are used throughout the description and claims to refer to particular features or components. As one skilled in the art will appreciate, different persons may refer to the same feature or component by different names. This document does not intend to distinguish between components or features that differ in name but not function.

For the embodiments and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

In some embodiments, the rotating equipment (e.g., motors) and valves disclosed herein are envisaged as being operable at specified speeds or variable speeds through inverter circuitry, for example. Moreover, the internal and external communication of the furnace may be accomplished through wired and or wireless communications, including known communication protocols, Wi-Fi, 802.11 (x), Bluetooth, to name just a few.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A heating, ventilation, and air conditioning (HVAC) system operable to use a refrigerant to heat or cool an indoor space and comprising:

a compressor, an outdoor heat exchanger, an indoor heat exchanger, a bi-flow expansion device, and a four-way valve operable to flow the refrigerant through the bi-flow expansion device in a first direction in a cooling mode or a defrost mode and in a second direction, opposite the first direction, in a heating mode;

a reheat a three-way valve positioned between the compressor and the four-way valve;

a first refrigerant line extending from downstream of the three-way valve to the reheat coil and a second refrigerant line extending from the reheat coil to upstream of the four-way valve; and a controller in communication with the compressor, the four-way valve, and the three-way valve, wherein the controller is programmed to, when in the defrost mode:

operate the three-way valve to flow only a portion of refrigerant, which is heated and compressed, from the compressor to the reheat coil through the first refrigerant line so that a supply airflow from the indoor heat exchanger to the indoor space is heated, flow the portion of refrigerant that flows through the reheat coil through the second refrigerant line to combine with a remainder of the refrigerant upstream of the four-way valve, operate the four-way valve to direct the combined refrigerant flow in the first direction through the outdoor heat exchanger to defrost the outdoor heat exchanger while the indoor heat exchanger operates as an evaporator, and operate the three-way valve to control how much of the portion of the refrigerant to flow to the reheat coil such that the supply airflow is heated so as to maintain a setpoint temperature of the heating mode.

2. The HVAC system of claim 1, further comprising a filter drier located between the bi-flow expansion device and the outdoor heat exchanger, wherein the filter drier is configured to filter particulate contamination in the refrigerant and capture moisture in the refrigerant.

3. A method of defrosting a heating, ventilation, and air conditioning ("HVAC") system operable to use a refrigerant to heat or cool an indoor space, the method comprising operating the system in a defrost mode when an outdoor heat exchanger has developed frost, comprising:

warming and compressing the refrigerant with a compressor;

flowing the compressed and heated refrigerant from the compressor through a three-way valve positioned between the compressor and a four-way valve;

flowing only a portion of the compressed and heated refrigerant from the three-way valve, through a first refrigerant line, and through a reheat coil;

flowing the portion of the refrigerant from the reheat coil through a second refrigerant line to combine with the remainder of the compressed and heated refrigerant upstream of the four-way valve;

flowing the combined portion and reminder of refrigerant through the four-way valve and an outdoor heat exchanger to defrost the outdoor heat exchanger; and flowing a supply airflow across an indoor heat exchanger, which cools the airflow, and the reheat coil, which reheats the airflow such that an indoor space set point-setpoint temperature of a heating mode is maintained.

4. The method of claim 3, further comprising:

filtering the refrigerant from the outdoor heat exchanger of particulate contamination with a filter drier located between the outdoor heat exchanger and a bi-flow expansion device; and capturing moisture from the refrigerant from the outdoor heat exchanger with the filter drier.

* * * * *